US005333526A

United States Patent [19]

Suzuki

[11] Patent Number: 5,333,526

[45] Date of Patent: Aug. 2, 1994

[54] RUNNING SAW SYSTEM

[75] Inventor: Yukitomo Suzuki, Tokyo, Japan

[73] Assignee: Heian Corporation, Shizuoka, Japan

[21] Appl. No.: 159,050

[22] Filed: Nov. 29, 1993

Related U.S. Application Data

[63] Continuation of Ser. No. 942,921, Sep. 10, 1992, abandoned.

[51] Int. Cl.[5] ..... B26D 1/18

[52] U.S. Cl. ..... 83/256; 83/404.1; 83/486; 83/863

[58] Field of Search ..... 83/51, 75.5, 151, 404.1, 83/485, 486, 863, 256; 144/376, 379

[56] References Cited

U.S. PATENT DOCUMENTS

| | | | |
|---|---|---|---|
| 1,870,656 | 8/1932 | Shipley | 144/376 X |
| 4,009,741 | 3/1977 | Zimmerman | 83/51 X |
| 4,230,004 | 10/1980 | Jonson | 144/379 X |
| 4,317,397 | 3/1982 | Ess | 83/404.1 X |
| 4,794,963 | 1/1989 | Oppeneer | 83/75.5 |
| 4,945,797 | 8/1990 | Hahn | 83/75.5 |
| 5,088,363 | 2/1992 | Jones et al. | 83/404.1 X |
| 5,142,955 | 9/1992 | Hale | 83/75.5 |
| 5,201,258 | 4/1993 | Cremona | 83/75.5 |

*Primary Examiner*—Rinaldi I. Rada
*Assistant Examiner*—Kenneth E. Peterson
*Attorney, Agent, or Firm*—Burgess, Ryan & Wayne

[57] ABSTRACT

A running saw system includes a carry portion having a plurality of rails, each rail having a plurality of rollers, a carry conveyor which carries the slab from an entrance port on the carry portion to the rails, the carry conveyor being attached to an entrance port of the carry portion, a rule plate attached to one side of the carry portion in parallel to the rails for setting a position of the slab, and a moving hook portion having hooks for supporting a rear edge of the slab and for intermittently moving the slab on the rails by only a predetermined distance; a traverse cut portion including a clamp for clamping a slab carried by the moving hook portion, and a cut saw for traversely cutting a front edge of the slab by only a predetermined width; a discharge conveyor for carrying this cut slab in a carrying direction and being attached near the traversed cut portion; a traverse conveyor which carries the cut slab in a direction traverse to the carrying direction of the discharge conveyor and which is attached near the discharge conveyor; and a plural cut portion which cuts the slab carried by the traverse conveyor into a plurality of smaller cut slabs of a predetermined size.

7 Claims, 5 Drawing Sheets

RUNNING SAW SYSTEM

This application is a continuation of application Ser. No. 07/942,921, filed Sep. 10, 1992, now abandoned.

BACKGROUND OF THE INVENTION

The present invention relates to a running saw system in which a large process board such as a face board is automatically cut off into a predetermined width, and the cut boards of a predetermined width are cut off into small parts of predetermined width at the same time.

In a known running saw device, after a large process board is such as a face board cut off into boards of predetermined width with a cut saw, the cut boards of predetermined width are successively transmitted and positioned to the next cut saw and cut off into small boards of predetermined width in order.

Therefore, when the process board which is cut off with the first running saw is cut off with the next one, the cut line at a right angle to the side of the process board is not precise. Also, because the large process board is cut off into small boards of the same size in order, the hook of the running saw for fixing the large board is frequently moved. Accordingly there has been a problem that the process time for dividing the large process board into small boards is longer.

SUMMARY OF THE INVENTION

It is, therefore, the primary object of the present invention to provide a running saw system in which a large process board is cut off into a predetermined width and the cut process boards are cut off into predetermined smaller widths all at once.

In order to accomplish the above and other objects, the present invention comprises a carry portion consisting of a carry conveyer for carrying a process board by positioning the process board with a rule plate on one side of the carry conveyer, a moving hook portion having plural hooks for supporting a rear edge of the process board and a passage portion for moving the process board thereon, a traverse cut portion having a cut saw for traversely cutting a front edge of the process board into a predetermined width, when the process board is moved with the moving hook portion into a predetermined length, a discharge conveyer for carrying the cut process board, a traverse conveyer for carrying the cut process board to a traverse direction of the discharge conveyer and a plural cut portion comprising a positioning carry portion for positioning the cut process board which is connected to the traverse conveyer, one fixed frame and plural moving frames, which are arranged to cross direction to the carrying direction of the cut process board, mounting cut saw portions respectively having cut saws and a distance set portion for setting the distances between the fixed frame and plural moving frames.

DESCRIPTION OF THE PREFERRED EMBODIMENTS

Figure 1:
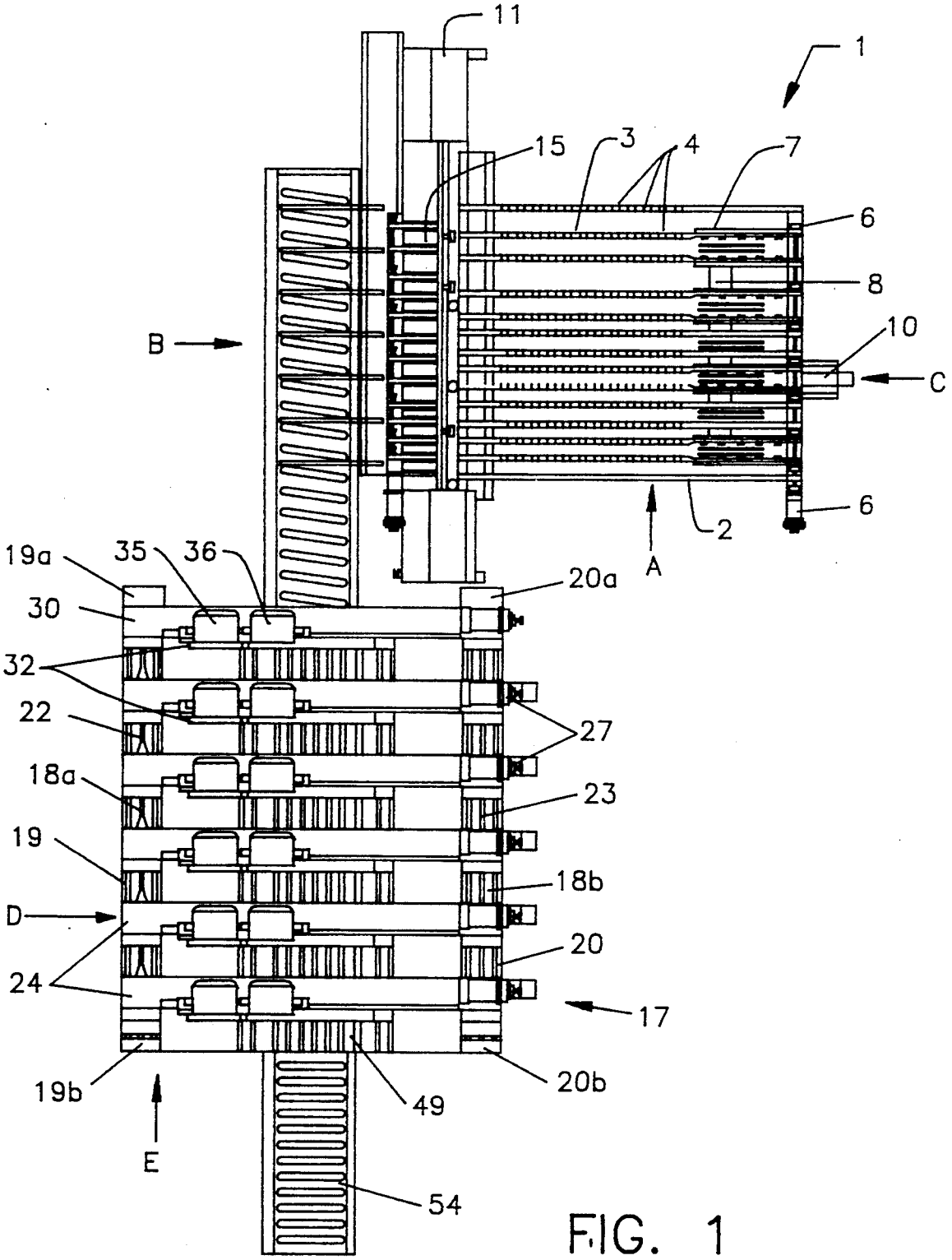
FIG. 1 shows a plane view of a running saw system of the present invention.
Figure 2:
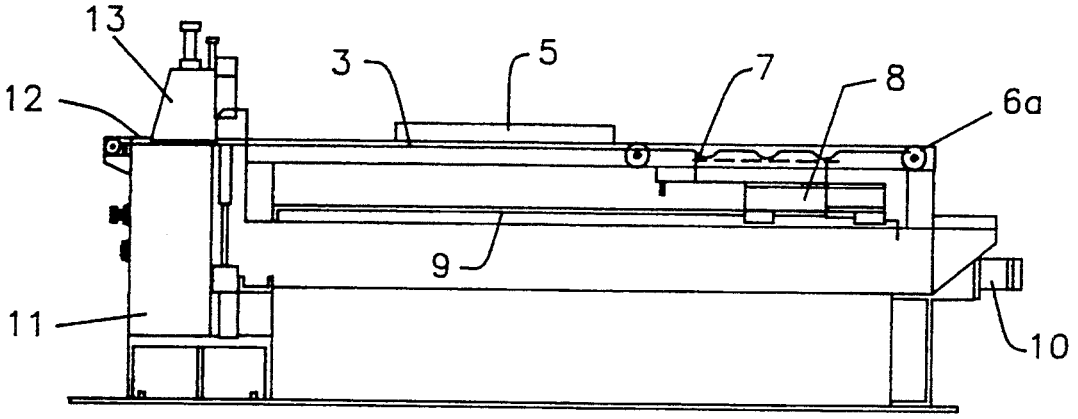
FIG. 2 shows an elevational view of a carry portion viewed in the direction A in FIG. 1.

Referring to the present invention in FIGS. 1 and 2, a rule plate 2 is fixed in a side of a carry portion 1, and a plurality of rollers 4 are respectively mounted on a plurality of rails 3 attached in parallel with the rule plate 2. A process board 5 is carried from a direction C, is transmitted on a carry conveyer 6 and is moved on a rail 3. When the process board 5 is passed through on hooks 7, the hooks 7 are raised on the rail 3 and are moved with a servomotor 10 forward and the back edge of the process board 5 is supported with the hooks 7. A moving hook portion 8 is supported so as not to turn by angle rails 9 and is moved to a predetermined distance.

Figure 3:
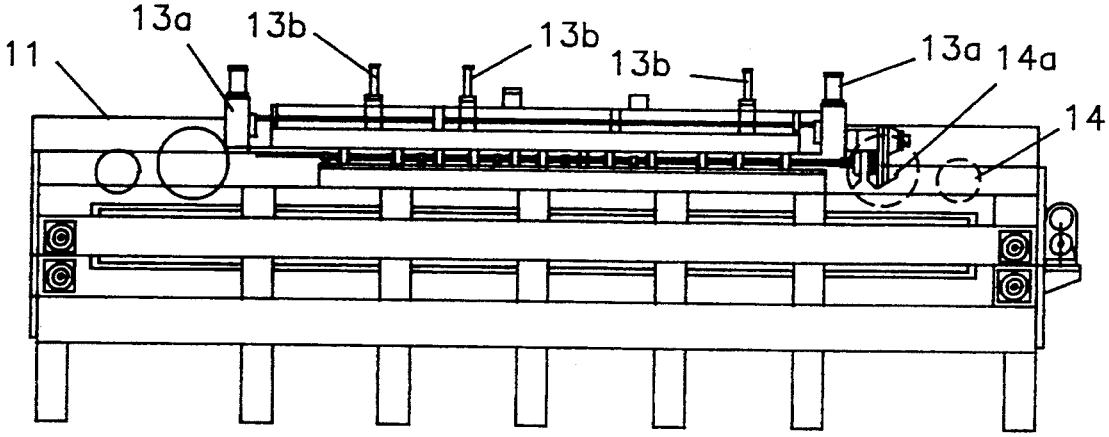
FIG. 3 shows an elevational view of a traverse cut portion viewed in a direction B in FIG. 1.

The back edge of the process board 5 is supported and moved with the hooks 7 of the moving hook portion 8 and when the front edge of the process board 5 projects by a predetermined length from a supporting stand 12 of a traverse cut portion 11 in FIG. 3, the process board 5 is clamped with clamp cylinders 13*a* and 13*b* of a clamp portion 13 in the upper portion. Then a cut saw portion 14 is traversely moved in the supporting table or stand 12, and the front edge of the process board 5 is cut with a cut saw 14*a* provided with the cut saw portion 14. The initial cutting of the front edge of the process board 5 is performed for truing up the front edge thereof and the process board 5 is cut in a predetermined length by the second cutting.

A cut process board which is cut in the cut saw portion 14 is transmitted to a traverse conveyer 16 with a discharge conveyer 15 from the traverse cut portion 11.

Figure 4:
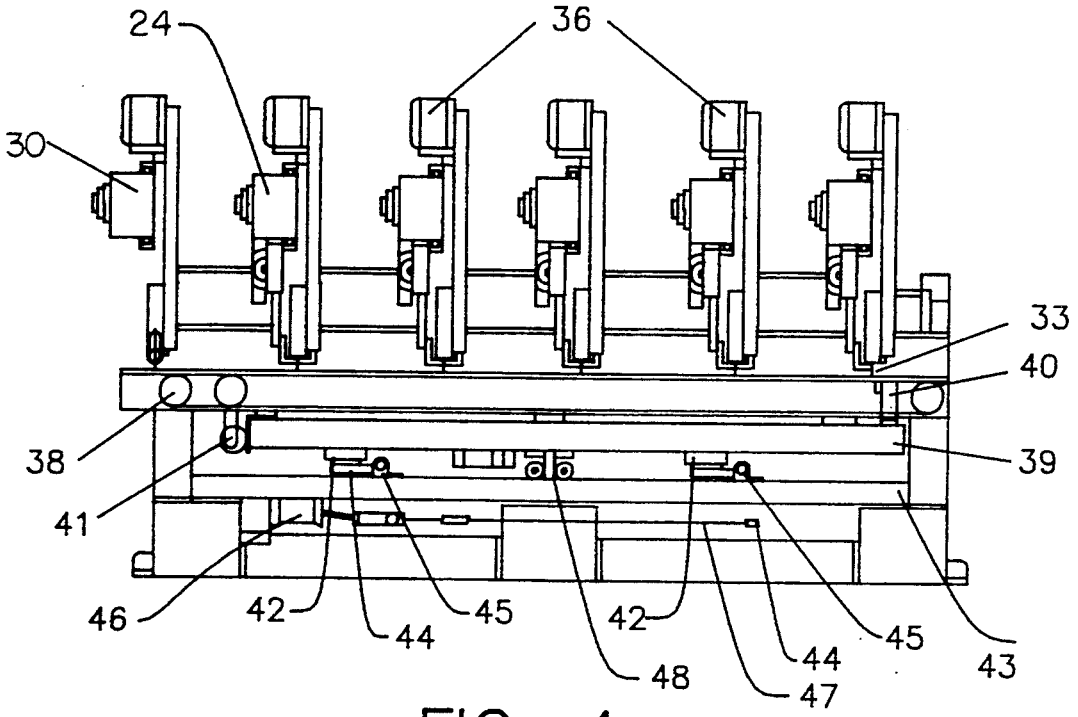
FIG. 4 shows an elevational view of a plural cut portion viewed in a direction D in FIG. 1.
Figure 5:
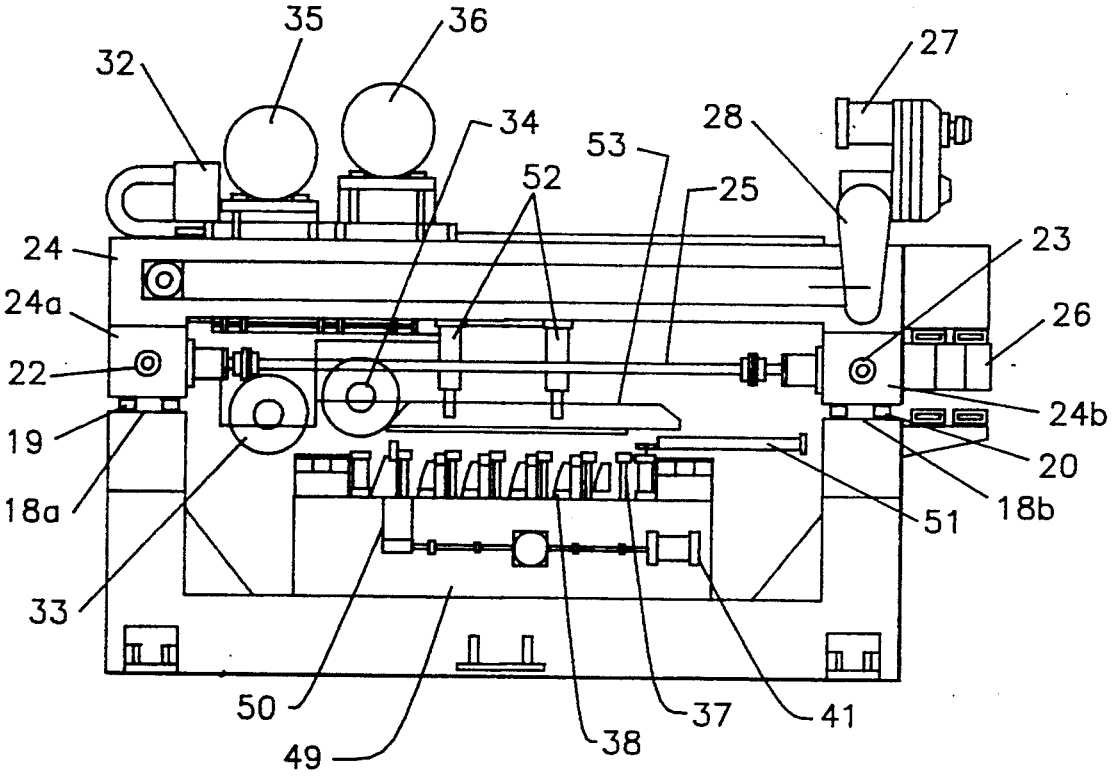
FIG. 5 shows a standing view of the plural cut portion to direction E in FIG. 1.

In FIGS. 1, 4 and 5, the traverse conveyer 16 is connected to a plural cut portion 17 with which a base portion 18 is provided. Rails 19 and 20 are mounted on the supporting portions 18*a* and 18*b* of both sides of the base portion 18. Both edges of two male screws 22 and 23 are respectively fixed to supporting portions 19*a*, 19*b*, 20*a* and 20*b* which are respectively attached to both sides of the rails 19 and 20. The male screws 22 and 23 are respectively engaged with female screws of engaging portions 24*a* and 24*b* of a plurality of moving frames 24. The female screws of the engaging portions 24*a* and 24*b* of the moving frames 24 are rotated by means of connect rods 25 and a motor 26 and the moving frames 24 are moved on the rails 19 and 20.

The fixed frame 30 near to the traverse conveyer 16 is fixed to the supporting portions 19*a* and 20*a* and the moving frames 24 are positioned on the basis of the fixed frame 30. Cut saw portions 32 are mounted on the moving frames 24 and the fixed frame 30, moving motors 27 and connection gears 28 are respectively mounted on the moving frames 24 and the fixed frame 30 and the moving motors 27, through the connection gears 28, move the cut saw portions 32 respectively. Two cut saws 33 and 34 are attached under each cut saw portion 32, motors 35 and 36 for rotating the cut saws 33 and 34 are mounted on the cut saw portions 32 and the cut saws 33 and 34 are inwardly rotated relative to each other. Each cut saw 34 in the cut saw portions 32 slightly cuts the cut process board and each cut saw 33 in the cut saw portions 32 cuts the line cut by the cut saw 34. Therefore, the finish of the cut line of the cut process board which is cut by the two cut saws 33 and 34 can be made beautiful.

In a positioning carry portion 49 which is connected with the traverse conveyer 16 as shown in FIGS. 4 and 5, carry conveyers 38 are respectively attached between a plurality of supporting tables 37, are mounted on a rise and fall frame 39 and are rotated by a conveyer motor 41. The conveyer motor 41 is mounted on the rise and fall frame 39 and a stopper 40 is attached to the one side of the rise and fall frame 39.

Supporting plates 42 are attached under the rise and fall frame 39 and are engaged with respective ends of turn arms 45 which are turned about their centers by turning shafts 44 fixed with a fixed frame 43. The other ends of each turn arm 45 is connected to a link 47 of a rise and fall cylinder 46 and a traverse prevent device 48 is mounted on the center of the rise and fall frame 39.

A rule plate 50 is fixed in one side of the positioning carry portion 49 and a board pushing cylinder 51 is attached to the other side of the positioning carry portion 49. Push cylinders 52 are respectively provided with the under portion of the moving frames 24 and the fixed frame 30 and push plates 53 are attached to the working shafts of the push cylinders 52. When the push plates 53 of the push cylinders 52 are lowered, the cut process board which is carried on the supporting tables 37 of the positioning carry portion 49 is set by the push plates 53 and is cut in the predetermined widths with the cut saws 33 and 34 and the cut process boards are tranmitted by the carry conveyer 38 to a discharge conveyer 54 and are discharged to the outside from the discharge conveyer.

Figure 6:
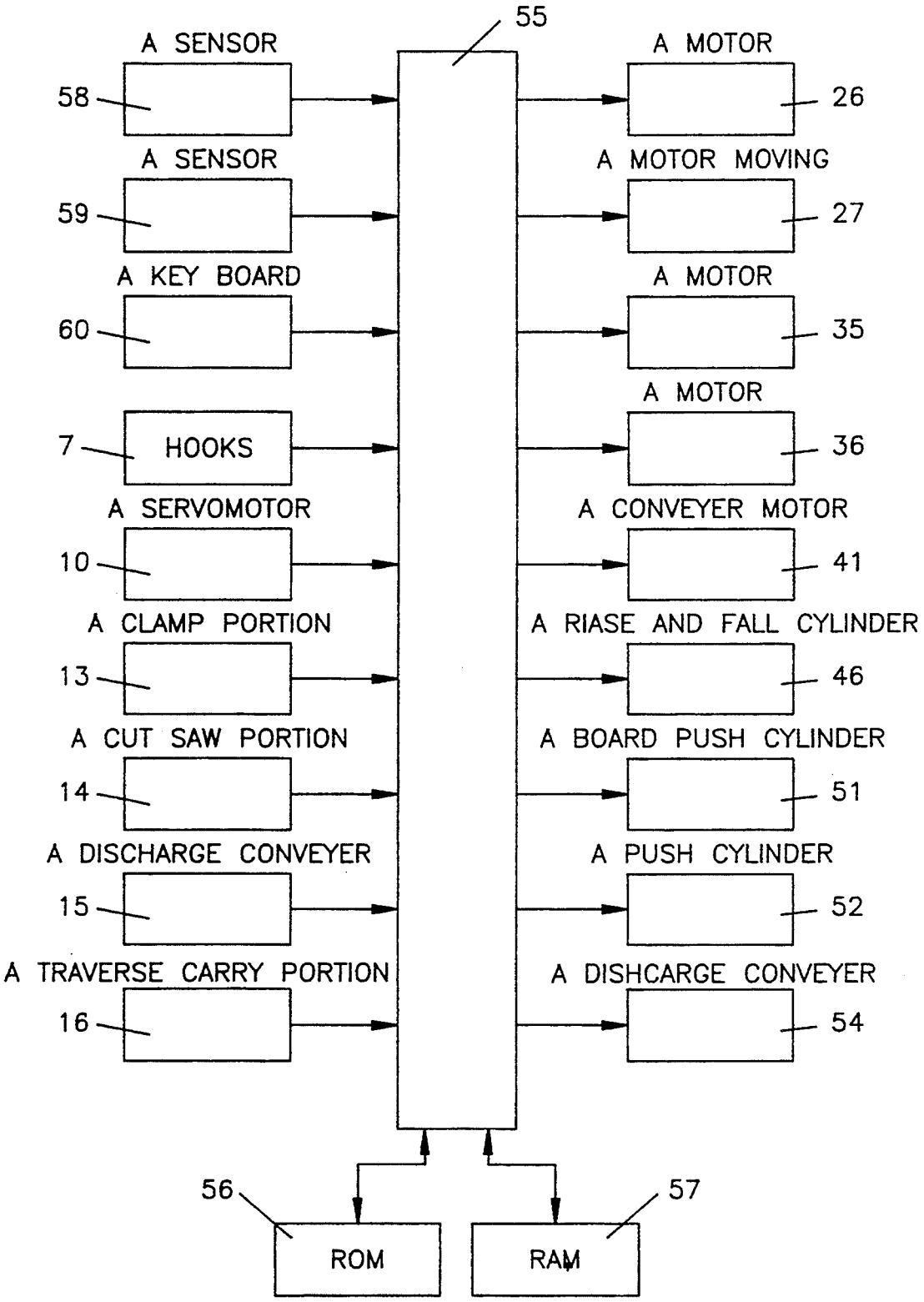
FIG. 6 shows a block diagram of a control device for controlling the running saw system in FIG. 1.

Referring to FIG. 6, a read only memory (ROM) 56 and a random access memory (RAM) 57 are connected to a central processing unit (CPU) 55 and the sensors 58 and 59 of the rule plates 2 and 50 and a key board 60 for setting cutting distances in the cut process board, that is distances between the fixed frame 30 and the moving frames 24 in turn, are connected to the input terminals of the CPU 55.

The motor 10 for moving the moving hook portion 8, the clamp portion 13 having the clamp cylinders 13*a* and 13*b*, the cut saw portion 14 for cutting the process board 5, the discharge conveyer 15 for transferring the cut process board and the traverse conveyer 16 are connected to the output terminals of the CPU 55. The motor 26 of the plural cut portion 17, motors 35 and 36 in the cut saw portion 32, the conveyer motor 41 of the carry conveyer 38, the rise and fall cylinder 46 of the rise and fall frame 39, the board pushing cylinder 51 of the positioning carry portion 49, the push cylinder 52 of the push plate 53 and discharge conveyer 54 are connected to the output terminals of the CPU 55.

Explaining the operation of the running saw system of the present invention, set values for setting the length for cutting the process board 5 (the distance for moving the hook moving portion 8) and the widths for cutting the cut process board (the distance between the fixed frame 30 and the moving frames 24) are applied to the CPU 55 and are memorized in the RAM 57 (Step 1).

For setting the cutting distances in the cut process board owing to the command from the CPU 55, the distance between the fixed frame 30 and the moving frame 24 to near to the fixed frame 30 and distances between the moving frames 24 each other are positioned by operating the motor 26 (Step 2).

The carry conveyers 38 and the rule plate 50 are raised above the supporting tables 37 by operating the rise and fall cylinder 46 (Step 3).

The CPU 55 waits to detect any signal from the sensor 58 of the rule plate 2 (Step 4). When the process board 5 is carried on the rails 3 with the carry conveyer 6 and is detected by the sensor 58 of the rule plate 2, the hooks 7 of the moving hook portion 8 are raised on the rails 3 and the rear edge of the process board 5 is fixed by the hooks 7 (Step 5).

Then servomotor 10 is moved by the values set by the key board 60 (Step 6), and the front edge of the process board 5 is transferred on the supporting table 12 of the traverse cutting portion 11.

The CPU 55 waits to detect due to the moving value of the servomotor 10 whether the front edge of the process board 5 projects only by the predetermined length (Step 7), and when the front edge of the process board 5 is projected the predetermined length, the clamp cylinders 13*a* and 13*b* of the clamp portion 13 are moved and push the process board 5 (Step 8).

Then, the cut saw portion 14 is moved to traverse the process board 5 and the cut saw 14*a* cuts the front portion of the process board 5 (Step 9). Also, when the front edge of the process board 5 is trued up, the front edge of the process board 5 is trued up by cutting the front edge thereof and the predetermined length thereof is cut. The fractions of the front edge and the rear edge of the process board fall on the way to the traverse conveyer 16.

The cut process board is transmitted from the discharge conveyer 15 to the traverse conveyer 16 and to the positioning carry portion 49 of the plural cut portion 17 (Step 10). The cut process board is moved to contact with the rule plate 50 by operating the carry conveyers 38 of the plural cut portion 17 (Step 11). Then, CPU 55 detects whether the cut process board is contacted with the sensor 59 of the rule plate 50 (Step 12), and when the sensor 59 does not detect the contact with the process board, the carry conveyers 38 are moved until the cut process board is contacted with the sensor 59. When the front edge of the cut process board is contacted with the sensors 59 on the rule plate 50, the carry conveyers 38 are stopped and fall, and the cut process board is pushed and positioned to the rule plate 50 by the board pushing cylinder 51 (Step 13).

The push cylinders 52 which are provided with the moving frames 24 and the fixed frame 30 set the cut process board on the supporting tables 37 by the push plates (Step 14). When the cut process board is set on the supporting tables 37, the motors 35 and 36 of the cut saw portion which are provided with the moving frames 24 and the fixed frame 30 are driven and the cut saws 33 and 34 are rotated, whereby the cut process board is cut into the predetermined widths (Step 15). When the cut board is subdivided, the front edge and rear edge of the cut process board is trued up by cutting with the cut saws 33 and 34 of the cut saw portions 32 in the fixed frame 30 and the moving frame 24 in the opposite side thereof.

Then the subdivided process boards are raised on the carry conveyers 38 of the positioning carry portion 49 which are raised over the supporting tables 37 and are carried on the discharge conveyer 54 (Step 16). After the above operation is finished, the CPU 55 detects whether the subdivision in one sheet of the process board 5 is finished with the number of the subdivision (Step 17), and if not finished, the operation is returned to the step 6. Then the hooks 7 of the hook portion 8 are moved the predetermined distance by operating the servomotor 10, the front edge of the process board 5 is again cut in the cut portion 11, the cut process board is transferred and is subdivided from the discharge conveyer 15 through the traverse conveyer 16 to the plural cut portion 17, and when all of the subdivisions of the cut process board are finished, the subdivision operation of one sheet of the process board 5 is finished. In the next step, when the process board 5 for cutting the same cut size is transferred to the carry portion 1, the operation is started at the step 4. Also, when the process board 5 for cutting the cut size different from the set size is transferred to the carry portion 1, the operation is started at the step 1 and the subdivision size is changed by the key board 60.

As stated above, in the running saw system of the present invention, the front edge of the process board is cut into the predetermined width and, the cut process board is cut into the predetermined widths in the plural cut portion. Therefore, because the subdivided process boards are cut at the same time, the efficiency in the present invention is improved over that of the known running saw and because the process board is fixed and cut at the cutting position, the cutting precision is improved. Furthermore, when the process board is positioned in the carry portion, the operation in the running saw system of the present invention becomes simple, because the process board is automatically positioned in the other portions.

Figure 7:
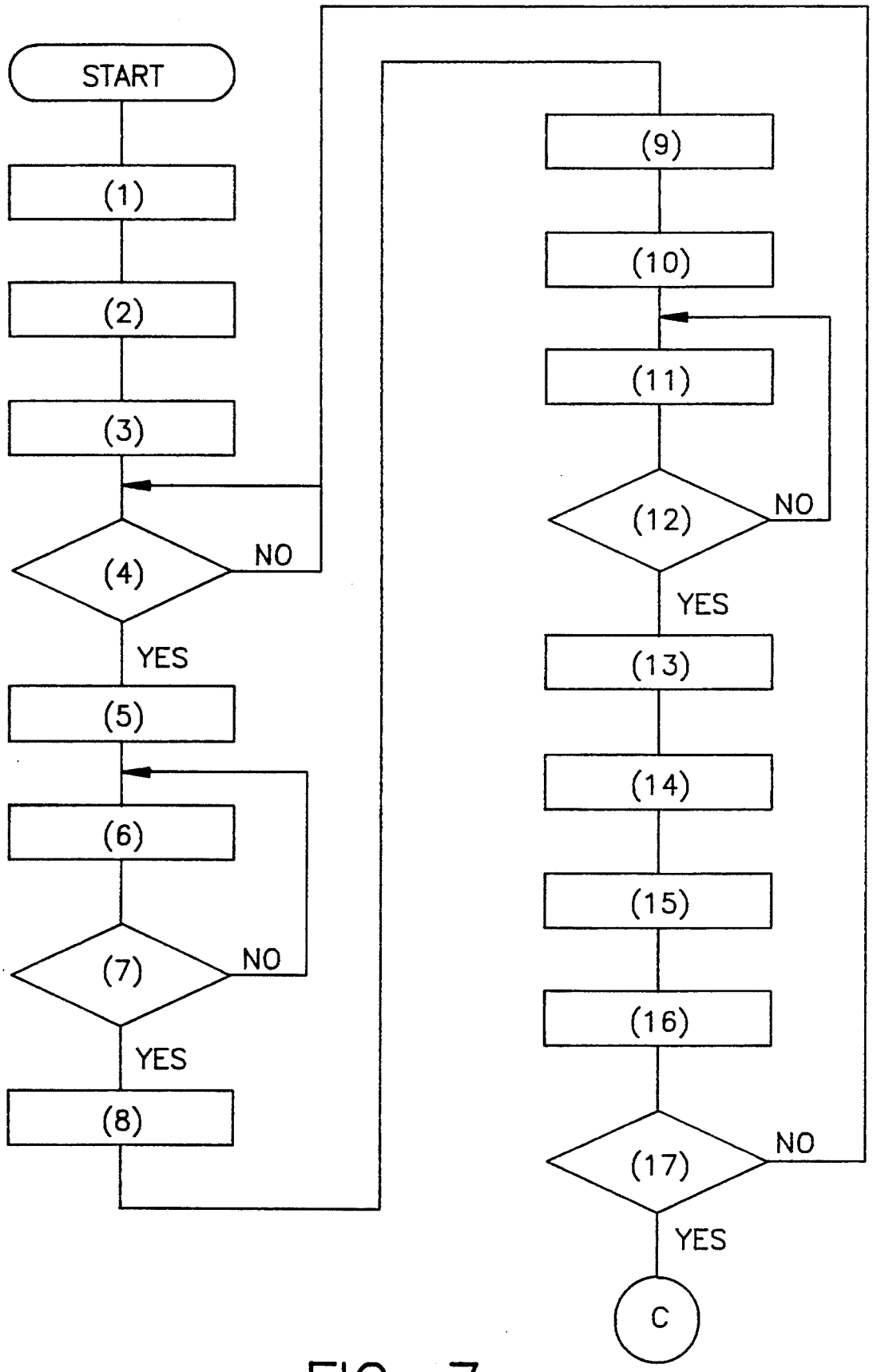
FIG. 7 shows a flow chart for explaining a motion of a running saw system in FIG. 1.

The above system, which is shown in FIG. 7, is summarized as follows:

(1) CUTTING LENGTH AND CUTTING WIDTH OF PROCESS BOARD 5 IS SET WITH KEY BOARD 60.

(2) BY COMMAND OF CPU, MOVING MOTOR 26 IS OPERATED, AND DISTANCES BETWEEN FIXED FRAME AND MOVING FRAME AND MOVING FRAME TO EACH OTHER.

(3) RISE AND FALL CYLINDER 46 IS OPERATED, CARRY CONVEYOR 38 AND STOPPER ARE RAISED.

(4) HAS THE PROCESS BOARD CARRIED IN?

(5) REAR EDGE OF PROCESS BOARD IS FIXED WITH HOOKS 7 OF MOVING HOOK PORTION 8.

(6) SERVOMOTOR IS MOVED BY PREDETERMINED VALUE.

(7) HAS FRONT EDGE OF PROCESS BOARD PROJECTED BY PREDETERMINED VALUE.

(8) CLAMP CYLINDER OF LAMP PORTION IS OPERATED TO CLAMP PROCESS BOARD.

(9) PROCESS BOARD IS CUT WITH CUT SAWS OF CUT SAW PORTION.

(10) CUT PROCESS BOARD IS CARRIED WITH DISCHARGE CONVEYOR AND CONVEYOR.

(11) CUT PROCESS BOARD IS CARRIED BY CARRY CONVEYOR OF PLURAL CUT PORTION.

(12) HAS FRONT EDGE OF PROCESS BOARD CONTACTED WITH STOPPER?

(13) CARRY CONVEYOR IS LOWERED, BOARD PUSH CYLINDER IS OPERATED, CUT PROCESS BOARD IS PUSHED TO RULE PLATE AND IS POSITIONED.

(14) PUSH CYLINDER IS OPERATED AND CUT PROCESS BOARD IS POSITIONED.

(15) CUT SAW OF CUT SAW PORTION IS ROTATED AND PROCESS BOARD IS CUT INTO PREDETERMINED WIDTH.

(16) CARRY CONVEYOR IS RAISED, SUBDIVIDED PROCESS BOARDS ARE THROUGH DISCHARGE CONVEYOR TO OUTSIDE.

(17) HAS SUBDIVISION OF ONE BOARD ENDED?

What is claimed is:

1. A running saw system for cutting a large rectangular piece into a plurality of smaller rectangular pieces, comprising:

a carry portion including:

a plurality of rails, each having a plurality of rollers and carry conveyor means for carrying a large rectangular piece from an entrance port of the carry portion to the rails, the carry conveyor means being arranged adjacent to the entrance port of the carry portion;

truing means for truing at least one edge of the large rectangular piece, said truing means including:

rule plate means arranged at one side of the carry portion in parallel with the rails, for contact with one edge of the large rectangular piece, moving hook portion means, having hooks for engaging a rear edge of the large rectangular piece, and for intermittently moving the large rectangular piece on the rails by a predetermined distance;

clamp means for clamping the large rectangular piece carried by the moving hook portion means, when the large rectangular piece has said one edge in contact with said rule plate means and cut saw means for traverse cutting a front edge of the large rectangular piece at a predetermined width, at a right angle to said one edge of the large rectangular piece, to form a cut piece;

sending conveyor means for carrying the trued piece in a carrying direction, said sending conveyor means being arranged adjacent to clamp means;

traverse conveyor means for carrying the cut piece in a direction traverse to the carrying direction of the sending conveyor means, said traverse conveyor means being arranged adjacent to the sending conveyor means; and a plural cut portion including:

carry conveyor means for moving the cut piece into contact with a stopper means at a positioning portion, rule plate means, movable vertically at one side of the plural cut portion, for setting one edge of the cut piece, pushing cylinder means for pushing the cut piece against the rule plate means, clamping means for clamping the trued piece by lowering with a lowering cylinder means, means for independently setting predetermined cutting distances between a fixed frame means and a moving frame means, and cut means mounted on the fixed frame means and the moving frame means for cutting the trued piece into a plurality of small rectangular pieces of lengths corresponding to the predetermined cutting distances.

2. A running saw system of claim 1, wherein the cut saw means comprises a rough cutting saw means and a precise cutting saw means.

3. A running saw system of claim 2, wherein said rough cutting saw means and said precise cutting saw means are aligned with each other so as to cut along the same line, one after the other.

4. A running saw system of claim 1, wherein the front edge and the rear edge of the large rectangular piece are cut at a right angle to the edge of the large rectangular piece which is in contact with the rule plate.

5. A running saw system for cutting a large rectangular piece into a plurality of smaller rectangular pieces, comprising: a carry portion including, a plurality of rails, each having a plurality of rollers, a carry conveyor means for carrying a large rectangular piece from an entrance port of the carry portion to the rails, the carry conveyor means being arranged adjacent to the entrance port of the carry portion, a rule plate means arranged at one side of the carry portion in parallel with the rails, for contact with one edge of the large rectangular piece, and a moving hook portion means, having hooks for engaging a rear edge of the large rectangular piece, and for intermittently moving the large rectangular piece on the rails by a predetermined distance; a traverse cut portion including, a clamp means for clamping the large rectangular piece carried by the moving hook portion means, and a cut saw means for traverse cutting a front edge of the large rectangular piece at a predetermined width, at a right angle to the one edge of the large rectangular piece to form a cut piece; a sending conveyor means for carrying the cut piece in a carrying direction, said sending conveyor means being arranged adjacent to the traverse cut portion; a traverse conveyor means for carrying the cut piece in a direction traverse to the carrying direction of the sending conveyor means, said traverse conveyor means being arranged adjacent to the sending conveyor means; and a plural cut portion including, a carry conveyor means for moving the cut piece into contact with a stopper means at a positioning portion, a rule plate means, movable vertically at one side of the plural cut portion, for setting one edge of the cut piece, a pushing cylinder means for pushing the cut piece against the rule plate means, a clamping means for clamping the cut piece by lowering with a lowering cylinder means, a means for independently setting predetermined cutting distances between a fixed frame means and a moving frame means, and a cut saw mounted on the fixed frame means and the moving frame means for cutting the cut piece into a plurality of small rectangular pieces of lengths corresponding to the predetermined cutting distances.

6. A running saw system of claim 5 wherein the cut saw means comprises a rough cutting saw means and a precise cutting saw means.

7. A running saw system of claim 5 wherein the front edge and the rear edge of the large rectangular piece are cut at a right angle to the edge of the large rectangular piece which is in contact with the rule plate.

* * * * *